US006676239B2

(12) United States Patent
Kao et al.

(10) Patent No.: US 6,676,239 B2
(45) Date of Patent: Jan. 13, 2004

(54) METHOD AND APPARATUS FOR USE IN INKJET PRINTING FOR REDUCING THERMAL ACCUMULATION DURING INKJET PRINTING

(75) Inventors: Chih-Hung Kao, Taipei (TW); Yu-Fan Fang, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/971,937

(22) Filed: Oct. 9, 2001

(65) Prior Publication Data

US 2002/0085053 A1 Jul. 4, 2002

(30) Foreign Application Priority Data

Oct. 9, 2000 (TW) ..... 89121139 A

(51) Int. Cl.[7] ..... B41J 29/38
(52) U.S. Cl. ..... 347/17; 347/41
(58) Field of Search ..... 347/17, 19, 12, 347/14, 41

(56) References Cited

U.S. PATENT DOCUMENTS 4,607,262 A * 8/1986 Moriguchi et al. ..... 347/196
4,685,069 A * 8/1987 Inui et al. ..... 364/506
5,300,969 A * 4/1994 Miura et al. ..... 347/12
5,485,179 A 1/1996 Otsuka et al.
5,818,474 A * 10/1998 Takahashi et al. ..... 347/15
6,106,093 A 8/2000 Nagoshi et al.
6,211,970 B1 * 4/2001 Cornell et al. ..... 358/1.9
6,213,579 B1 * 4/2001 Cornell et al. ..... 347/14

FOREIGN PATENT DOCUMENTS

DE 42 21 963 A1 6/1992

* cited by examiner

*Primary Examiner*—Stephen D. Meier
*Assistant Examiner*—Lam Nguyen
(74) *Attorney, Agent, or Firm*—Rabin & Berdo, P.C.

(57) ABSTRACT

A method and apparatus for use in inkjet printing. The apparatus includes a memory, a heat accumulation calculation device, and an image separating device. The memory is used to store a heat weighting look-up table. When data representative of the image is fed into the heat accumulation calculation device, a heat weighting for the image can be calculated according to the heat weighting look-up table, which can be used to determine the degree of heat accumulation during printing. The image separating device then outputs pieces of image data representing sub-images according to the heat weighting for the image. Finally, the image is formed by printing the sub-images successively according to the pieces of image data. In addition, for some regions where serious heat accumulation is predicted, the densities of the pixels to be printed within the regions can be adjusted to reduce the degrading effect on the printing quality due to the heat accumulation during printing.

14 Claims, 6 Drawing Sheets

115

115

115

METHOD AND APPARATUS FOR USE IN INKJET PRINTING FOR REDUCING THERMAL ACCUMULATION DURING INKJET PRINTING

This application incorporates by reference Taiwanese application Serial No. 89121139, filed on Oct. 9, 2000.

BACKGROUND OF THE INVENTION

1. Field of the Invention

The invention relates in general to a method and an apparatus for forming images, and more particularly to a method for forming images with inkjet printing techniques and an apparatus therefor.

2. Description of the Related Art

Over the years, electronic related industries progress as the technology advances. For various electronic products, such as computer systems, computer peripherals, appliances and office machines, their functions and appearances are improved greatly as well. For example, in the 1980s, impact-type dot matrix printers and monochrome laser printers were pre-dominant. Later in the 1990s, monochrome inkjet printers and color inkjet printers became popular for common uses while color laser printers were available for professional uses. For common end users who do not print documents frequently, they would probably select color inkjet printers after considering the printing quality and price. People with sufficient budgets would probably purchase a monochrome laser printer. Since the price and quality are critical to the users' choices, printer vendors aggressively develop their products so that the products have lower cost and better quality so as to increase popularity and profits of their products. Therefore, developers are focusing on how to improve the performance of products under limited cost.

Most inkjet printers now use thermal inkjet print head or piezo-electrical inkjet print head to spray ink droplets onto a sheet of medium, such as paper, for printing. The thermal inkjet print head includes ink, heating devices, and nozzles. The heating devices are to heat the ink to create bubbles until the bubbles expand enough to burst so that ink droplets are fired onto the sheet of paper through the nozzles and form dots or pixels on the sheet of paper. Varying the sizes and locations of the ink droplets can form different texts and graphics on a sheet of paper.

The quality of printing is closely related to the resolution provided by the printers. Currently, entry-level color printers provide a maximum resolution of 720 by 720 dot per inch (dpi) or 1440 by 720 dpi. Higher resolution requires finer size of the droplets. The size of the droplets is related to the cohesion of the ink. For instance, for droplets having identical amount of ink, ink with greater cohesion may have a smaller range of spread when they fall onto the paper, resulting in clearer and sharper printing. In the process of printing with the thermal inkjet technology, the heating elements of a print head are activated to heat up the ink in the print head for the creation of bubbles so that ink droplets are ejected from the nozzles onto a sheet of paper. As the temperature of the ink rises, the viscosity of the ink becomes lower. If the temperature of the ink is higher than a predetermined level, the viscosity of the ink could be abnormally low and ink droplets to be ejected would form larger dots onto the sheet of paper, resulting in a degraded quality of printing. Thus, the temperature control of the ink is a key to the improvement of the printing quality.

Referring to FIG. 1, it shows a block diagram of the structure of a convention inkjet printer. The inkjet printer includes a central processing unit (CPU) 110, a printing controller 120, a print head driver 130, and a print head 140. During printing, data representative of images to be printed are fed into the inkjet printer. After processing of the data, the CPU 120 feeds image data 115 into the printing controller 120. The image data 115 includes information of locations, colors, and density of pixels corresponding to the images to be printed. In response to the image data 115, the printing controller 120 controls the print head driver 130 and the print head driver 130 causes the print head 140 to print the images. Referring to FIG. 2, it gives an illustration of a portion of nozzles arranged on the print head 140. For the sake of simplicity, the nozzles of the print head 140 are represented as an array of nozzles 140. The print head 140 includes a plurality of nozzles and heating elements, and each of the heating elements is disposed in proximity to an associated nozzle to heat ink close to the nozzle for the ejection of ink droplets.

In course of printing, a nozzle may eject ink droplets consecutively. The heat generated by the heating element associated with the nozzle may accumulate because consecutive triggering signals are applied to the heating element while there is no enough time for the heat produced to release completely. Besides, the ink temperature near the nozzle may also be greater than that near the other nozzles. If the heat accumulation is not well compensated, the ink temperatures near different nozzles will be different from each other. The ink near different nozzles may have different viscosity. The ink droplets ejected from different nozzles would be of different sizes, resulting in a degraded printing quality. Thus, temperature compensation is necessary for improving the printing quality of thermal inkjet printing.

Conventional, there are two techniques for temperature compensation for use in inkjet printing apparatuses. In the first approach, temperature compensation is based on the temperature of the nozzles measured by a thermal resistor arranged near the nozzles. In addition, the temperature of the nozzles is determined by the variation of the resistance of the thermal resistor. However, the temperature obtained in this way is an average temperature of a part or all of the nozzles whereas the temperatures of specific nozzles are unobtainable. In other words, if abnormal temperature increase is observed, it is still not possible to identify the specific nozzles that cause the temperature rise in such conventional approach. Therefore the temperature compensation actions taken may not be appropriate.

In the second approach, temperature compensation is based on predictions about heat accumulation while the predictions are made by analyzing pixels of the image desired to be printed. If the formation of the images on a sheet of printing medium requires the ejection of a large number of ink droplets corresponding to the pixels of the images, a high degree of heat accumulation is expected. Conversely, if the formation of the images on the sheet of printing medium requires the ejection of a small number of ink droplets corresponding to the pixels of the images, a low degree of heat accumulation is expected. During printing, in order to achieve temperature compensation, evaluation of energy applied to each of the nozzles is made in accordance with the predications about heat accumulation. However, during consecutive ejection of ink droplets, heat release of the nozzles is incomplete so the heat accumulation is still happening in each nozzle. Thus, the second approach is unable to effectively resolve the problem on heat accumulation in the nozzles.

From the discussions above, it can be understood that the conventional temperature compensation approaches have two major disadvantages as follows.

1. Only the average temperature of a part or all of the nozzles of a print head is obtainable in the first approach, so the temperature compensation may be inadequate to reduce the effects of abnormal temperature variations in individual nozzles.
2. During consecutive ejection of ink droplets, though temperature compensation of the second approach is performing, there is still heat energy remaining in the nozzles, and the effects of heat accumulation is thus not effectively resolved.

SUMMARY OF THE INVENTION

It is therefore an object of the invention to provide a method and an apparatus for forming an image with inkjet printing techniques so that the degrading effects of heat accumulation on printing quality is reduced and the printing quality can thus be improved. According to the invention, data representative of the image is separating into m pieces of image data representing m sub-images and the m sub-images are printed successively according to the m pieces of image data. Besides, the data representative of the image can be adjusted for the reduction in heat accumulation during printing the sub-images.

The invention achieves the above-identified object by providing an image forming method for use in an inkjet device for forming an image on a printing medium. The image forming method includes the following steps. Firstly, provide data representative of the image. Then, m data masks for masking the data representative of the image is provided so as to obtain m pieces of image data representing m sub-images, wherein m is an integer greater than one. The m sub-images is then printed according to the m pieces of image data representing the m sub-images so that the m sub-images are superimposed on the printing medium, whereby the image is formed on the printing medium.

Besides, the degree of heat accumulation during printing is predicted by determining a heat weighting for the image based on the locations of the pixels to be printed for the image. Further, for one of the m pieces of image data which has some pixels to be printed may cause serious heat accumulation during printing, the densities of these pixels to be printed can be adjusted so as to reduce the effect of the heat accumulation on the printing quality. The effect of the heat accumulation on the printing quality can also be reduced by reducing the densities of the data representing the image according to the degree of heat accumulation predicted before the obtaining of the m pieces of image data.

The invention achieves the above-identified object by providing an apparatus for controlling inkjet printing. The apparatus includes a memory, a heat accumulation calculation device, and an image separating device. The memory is used to store a heat weighting look-up table. The heat accumulation calculation device is coupled to the memory and is used for receiving data representative of an image and outputting a heat weighting for the image according to the heat weighting look-up table. The image separating device is coupled to the heat accumulation calculation device and is used for receiving the data representative of the image and outputting m pieces of image data representing m sub-images according to the heat weighting for the image.

Other objects, features, and advantages of the invention will become apparent from the following detailed description of the preferred but non-limiting embodiments of the invention with reference to the accompanying drawings.

DESCRIPTION OF THE PREFERRED EMBODIMENT

The principle of the invention is to separate (either dividing or decomposing) data representative of an image into a set of data representing sub-images of the image and to print a succession of the sub-images so that the sub-images are superimposed onto a printing medium to form the image on the printing medium. Besides, the data representing a plurality of sub-images of the image are generated with respect to heat accumulation distribution based on both the data representative of the image and arrangement of the nozzles of the print head.

Since each sub-image is a constituent of the whole image, the heat accumulation produced during printing each sub-image is much less than that for the whole image. In addition, during the printing of the successive sub-images, the heat produced from the ejection of an ink droplet can be released thereafter so that the entire heat accumulation produced from the formation of the image in this way is much less than that produced from the whole image printed directly. As a result, the image is formed on the printing medium and heat accumulation occurred during the printing is effectively reduced.

Embodiment 1

Figure 1:
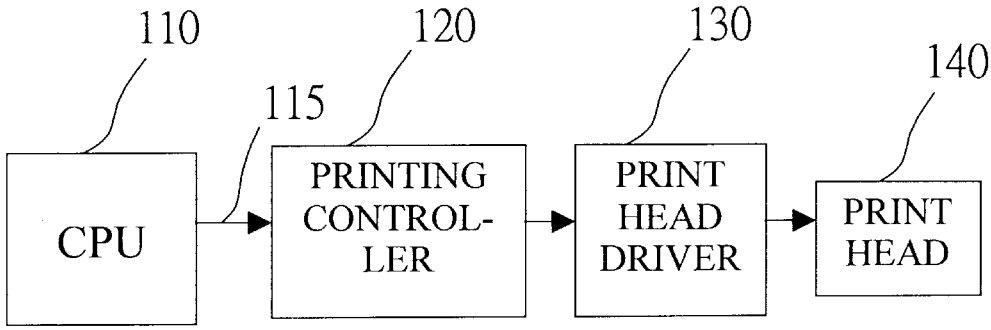
FIG. 1 (PRIOR ART)
FIG. 1 (Prior Art) is a block diagram of a conventional inkjet printer.
Figure 2:
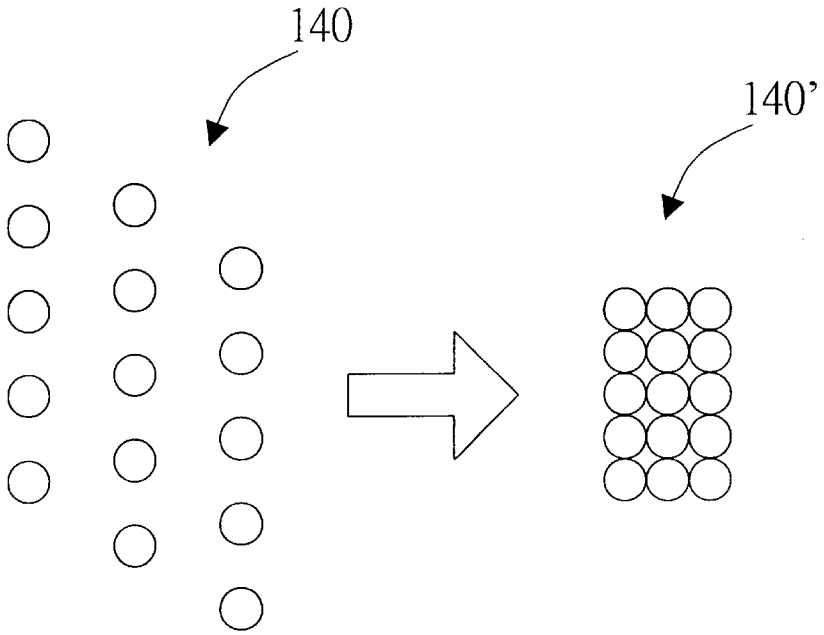
FIG. 2 (PRIOR ART)
FIG. 2 (Prior Art) illustrates nozzles arranged on a print head shown in FIG. 1.
Figure 3A:
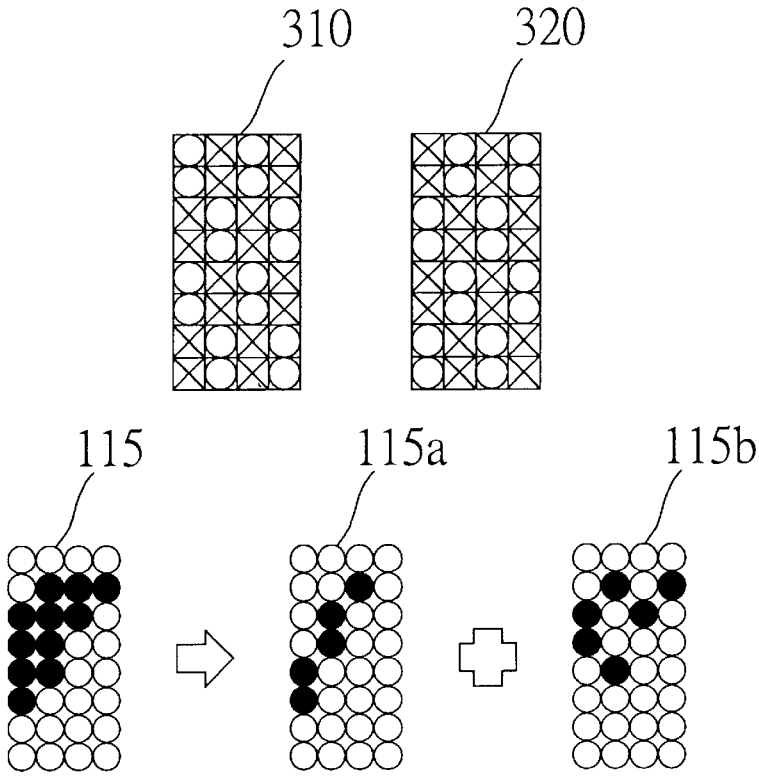
FIG. 3A illustrates the formation of an image by the application of a method of image forming with inkjet printing techniques according to a first embodiment of the invention.

FIG. 3A illustrates an image forming method for use in inkjet printing according to the first embodiment. First, a number of data masks for masking data representative of an image to be printed are provided in order to generate a number of pieces of image data representing sub-images of the image to be printed. Next, the sub-images are successively printed and superimposed onto a printing medium so as to form the image.

As shown in FIG. 3A, data masks 310 and 320 are provided for masking image data 115 representative of an image to be printed, wherein the data masks 310 and 320 are complementary patterns. Suppose that the image data 115 is an array of 8 by 4 pixels, including pixels to be printed and blank pixels. That is, the image is formed with a number of black dots and blank area that is indicated by small hollow circles. Besides, every pixel of the image data 115 is associated with one of the nozzles, and the nozzles eject ink droplets corresponding to the black dots of the image. When the data mask 310 is applied to the image data 115, a piece of image data representing a sub-image for the image, or simply called a sub-image data unit 115*a,* is obtained. When the data mask 320 is applied to the image data 115, another piece of image data representing another sub-image for the image, or simply called a sub-image data unit 115*b,* is obtained. Since the data masks 310 and 320 are complementary patterns, the pieces of image data, i.e. the sub-image data units 115*a* and 115*b,* compose the image data 115. If inkjet printing is performed according to the two sub-image data units 115*a* and 115*b* successively, the two sub-images will superimpose onto the printing medium and form the whole image on the printing medium.

By the image forming method above, heat accumulation during the inkjet printing of an image is distributively reduced. For the image data 115, the pixels to be printed, as observed, are densely distributed and are surrounded by the blank pixels. If ink droplets are ejected only once for the formation of the image on the printing medium, serious heat accumulation will occur in the nozzles which correspond to the pixels to be printed and through which the ink droplets are ejected. On the other hand, for the sub-image data unit 115*a* and 115*b,* their pixels to be printed are loosely distributed as compared with that of the original image data 115. In this regard, during the inkjet printing according to each of the pieces of image data representing the sub-images, heat accumulation in nozzles becomes smaller. In addition, after the printing according to the sub-image data unit 115*a,* a portion of heat is released by way of the ink ejection. When the sub-images are printed according to the sub-image data unit 115*b,* a proportion of heat accumulated during the previous sub-image printing has been reduced. In other words, heat release is allowed between successive sub-image printing. Therefore, the heat accumulation occurred during the inkjet printing of the image is effectively reduced according to the invention.

Figure 3B:
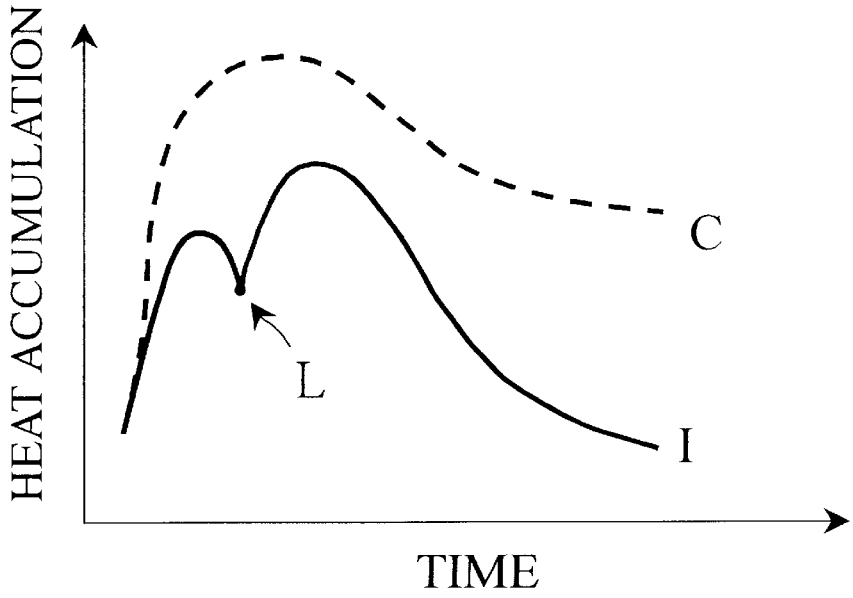
FIG. 3B are comparative graphs of the amounts of heat accumulation produced in nozzles during the printing of the image in FIG. 3A versus time for the comparison of the image forming method illustrated in FIG. 3A and the conventional approach without using temperature compensation.

FIG. 3B shows graphs of the amount of heat accumulation versus time for the comparison between the conventional approach and the invention. In FIG. 3B, a curve I is representative of the amount of heat accumulation during the inkjet printing of the image according to the image forming method as illustrated in FIG. 3A. A curve C is representative of the amount of heat accumulation occurred during the inkjet printing of the image according to the conventional approach without temperature compensation that continuously prints the image in one time. As described above, the heat accumulation for the conventional approach is serious because the pixels to be printed are densely distributed and printed for one time. On the other hand, by the invention, the heat accumulation is distributively released during the printing of a succession of the sub-images of the image. Between successive sub-image printing, there may be a minimum amount of heat accumulation, indicated by a point L in FIG. 3B. As a result, the heat accumulation for the invention is much lower than the conventional approach.

Embodiment 2

Figure 4A:
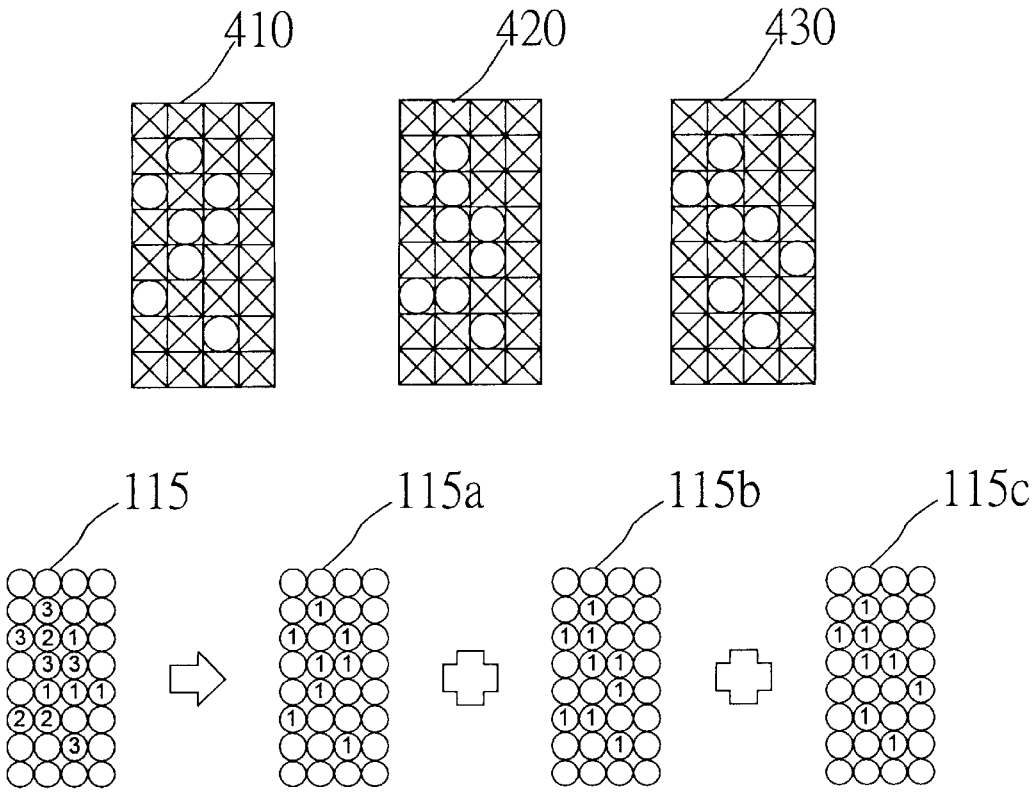
FIG. 4A illustrates the formation of an image by the application of a method of image forming with inkjet printing techniques according to a second embodiment of the invention.

FIG. 4A illustrates an image formation method for use in inkjet printing according to a second embodiment of the invention. Suppose that the image data 115 representative of an image to be printed is an array of 8 by 4 pixels, including blank pixels and pixels to be printed with different densities. That is, the image has blank area and a number of dots having different densities. The blank area is indicated by small hollow circles. Each dot with an individual density is indicated by a circle surrounding a number, wherein the number indicates the density of the dot. As observed from FIG. 4A, the image data 115 contain twelve pixels to be printed and these pixels are of densities 1, 2, and 3. According to the principle of the invention, the image is formed by the superimposition of sub-images that are printed according to a number of sub-image data units, where the sub-image data units are generated by applying a number of data masks to the image data 115. Besides, the data masks applied in the second embodiment are provided in accordance with the contents of the image data 115. That is, the data masks are provided according to locations and densities of the pixels to be printed in the image data 115. For the pixels that are to be printed with higher densities, heat accumulation may occur seriously. The data masks based on the locations and densities of the pixels to be printed can lead to the pixels of higher densities to be printed in a succession of printing. Thus, the serious heat accumulation can be effectively reduced.

Figure 4B:
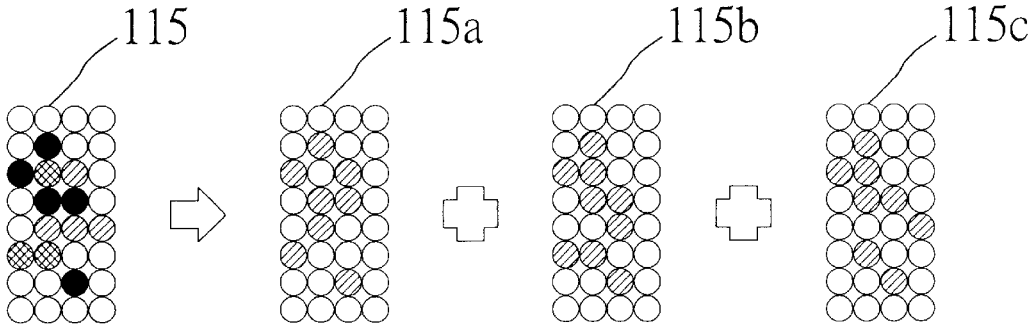
FIG. 4B illustrates the densities of the image and its sub-images shown in FIG. 4A.

As illustrated in FIG. 4A, data masks 410, 420, and 430 can be defined with reference to the locations and densities of the pixels to be printed. By applying the data masks 410, 420, and 430 to the image data 115, sub-image data units 115*a,* 115*b,* and 115*c* are obtained respectively. Finally, the image is formed on a printing medium by printing according to the sub-image data units 115*a,* 115*b,* and 115*c.* FIG. 4B illustrates the densities of the pixels of the image data 115, and the constituent sub-image data units 115*a,* 115*b,* and 115*c.* As illustrated, the application of the data masks to the image data 115 produces the three sub-image data units with lower densities. The formation of the whole image on the printing medium is resulted from the superimposition of the printing according to the sub-image data. Since the pixels with higher densities are formed by driving the corresponding heating elements for two or three times in different time frames, the total heat accumulation during the printing of the successive sub-images is reduced.

As described above, the second embodiment uses data masks concerning both the locations and densities of the pixels to be printed, while the first embodiment uses data masks with predetermined patterns but does not concern the different density of each pixel. Therefore, the second embodiment may have better performance in reducing heat accumulation comparing with the first embodiment in certain circumstances.

In the following, a method for predicting heat accumulation is provided according to locations of the pixels of an image. This method results in predication values that can be involved into the generation of the data masks.

Embodiment 3

Data masks are provided for applying to an image in order to obtain a number of sub-image data units. As described above, data masks in the first embodiment are defined in the forms of complementary patterns while data masks in the second embodiment are defined according to locations and densities of the pixels to be printed. The locations of the pixels to be printed can be further used to predict the degree of heat accumulation occurred in the printing of each sub-images. The predicted heat accumulation degrees can be used as a basis for the generating of data masks. By applying these data masks to the image, a number of sub-image data units are to be generated so that the portions of the image that may lead to heavy heat accumulation during printing, such as pixels with higher densities (darkness) or pixels clustered together, can be formed on the printing medium through several times of printing. In this way, the data masks can be better defined so that the heat reduction during printing process is more effectively.

Accordingly, a heat weighting look-up table is provided for use in the determination of an amount indicative of heat accumulation based on the locations of image pixels to be printed. The amount indicative of heat accumulation determined for an image in this way is called the heat weighting for the image. With this heat weighting for the image, the heat accumulation degree of the image during printing can be predicted. The larger the heat weighting for the image, the more densely distributed the image pixels to be printed. The more densely distributed the image pixels to be printed, the more serious the heat accumulation during printing. Conversely, the smaller the heat weighting for the image, the less serious the heat accumulation during printing. The heat weighting look-up table includes a heat accumulation table and a heat release table, e.g. as shown in TABLE 1 and 2 respectively as follows.

TABLE 1

| Pixel to be printed | A single pixel | Two successive pixels | Three successive pixels | Four successive pixels | Five successive pixels | ... |
|---|---|---|---|---|---|---|
| Heat accumulation weight | a | b | c | d | e | ... |
| Heat weighting W | 1 | 2 | 3 | 4 | 5 | ... |

TABLE 2

| Blank pixel | A single pixel | Two successive pixels | Three successive pixels | Four successive pixels | Five successive pixels | ... |
|---|---|---|---|---|---|---|
| Heat release weight | A | B | C | D | E | ... |
| Heat weighting W | 0 | −1 | −2 | −3 | −4 | ... |

The heat weighting for an image to be printed is obtained by the summation of the heat weighting for each pixel to be printed, e.g. from the first pixel to be printed to the last pixel to be printed. If there are successive pixels to be printed, heat accumulation weights for these pixels are accumulated, indicating that the pixels to be printed are densely distributed and heat produced during printing for these pixels is predicted to accumulate. Conversely, if there are successive blank pixels between the pixels to be printed, the heat release weights are accumulated, indicating that the heat accumulation during printing is predicted to have reduction due to the occurrence of the blank pixels. The heat weighting W for the image is equal to summation of the heat accumulation weights obtained for all pixels to be printed and the heat release weights obtained for all blank pixels among the pixels to be printed. In the following, examples of calculating the heat weighting will be illustrated.

Figure 5B:
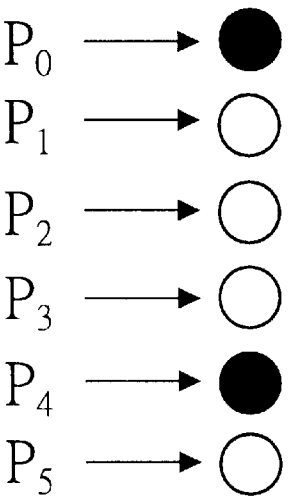
FIGS. 5A and 5B illustrate the calculation of heat weighting for a one-dimensional image.
Figure 5A:
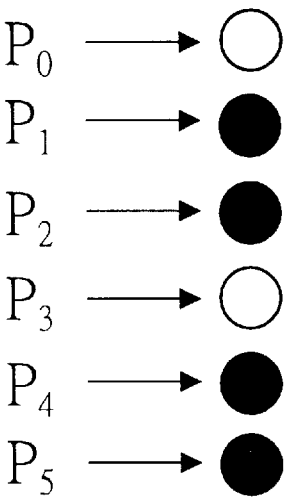

FIGS. 5A and 5B illustrate the calculation of heat weighting for one-dimensional image. As shown in FIG. 5A, image data 115 is representative of a line containing 4 pixels to be printed and two blank pixels. The pixels to be printed are located at $P_1$, $P_2$, $P_4$ and $P_5$ respectively while the blank pixels are located at $P_0$ and $P_3$. Please note that in this embodiment the calculation of heat weighting W for the image data 115 begins from the first pixel to be printed, i.e. from $P_1$. Since $P_0$ is a blank pixel, it is neglected and the calculation of the heat weighing has not started yet. The first pixel to be printed is $P_1$ so now the calculation of the heat weighing starts and the heat accumulation weight a is added to the heat weighting W. $P_2$ is also a pixel to be printed and immediately follows $P_1$, so $P_2$ is the second pixel to be printed in this line and the heat accumulation weight b is added to the heat weighting W. $P_3$ is a blank pixel and does not immediately follow any other blank pixels, so the heat release weight A is added to the heat weighting W. $P_4$ is a pixel to be printed and does not immediately follow any other pixel to be printed, so the heat accumulation weight a is added to the heat weighting W. $P_5$ is a pixel to be printed and immediately follows $P_4$, so the heat accumulation weight b is added to the heat weighting W. Since $P_5$ is the last pixel to be printed in the printing of the line represented by the image data 115, the calculation of heat weighting stops. Please note that the calculation of heat weighting stops at the last pixel to be printed. In other words, the remaining blank pixels after the last pixel to be printed will all be neglected. Therefore, the summation of the heat accumulation weights and the heat release weights is a+b+A+a+b=2a+2b+A. According to TABLES 1 and 2, the heat weighting W for the image data 115 shown in FIG. 5A is 2*1+2*2−0=6.

To better reflect the heat accumulation and heat release phenomenon, in this embodiment the calculation of the heat weighing W starts at the first pixel to be printed and ends at the last pixel to be printed, meanwhile neglecting the blank pixels located before the first pixel to be printed and the blank pixels located after the last pixel to be printed.

In another example as shown in FIG. 5B, image data 115 is representative of a line containing 2 pixels to be printed and 4 blank pixels. The pixels to be printed are located at $P_0$ and $P_4$ while the blank pixels are located at $P_1$, $P_2$, $P_3$ and $P_5$. The calculation of heat weighting W for the image data 115 begins from the first pixel to be printed, i.e. from $P_0$. The first pixel to be printed is $P_0$ so the heat accumulation weight a is added to the heat weighting W. $P_1$ is a blank pixel and does not immediately follow any other blank pixel, so the heat release weight A is added to the heat weighting W. $P_2$ is a blank pixel and immediately follows the blank pixel $P_1$, so the heat release weight B is added to the heat weighting W. $P_3$ is also a blank pixel and is the third pixel in the line with three successive blank pixels, so the heat release weight C is added to the heat weighting W. $P_4$ is another pixel to be printed and does not immediately follow any other pixels to be printed, so the heat accumulation weight a is added to the heat weighting W and the calculation of the heat weighting W is completed. The summation of the heat accumulation weights and the heat release weights is a+A+B+C+a=2a+A+B+C. According to TABLES 1 and 2, the heat weighting W for the image data 115 shown in FIG. 5B is 2*1−0−1−2=−1.

Referring now to FIGS. 5A and 5B, it is apparent that in image data 115 of FIG. 5A, pixels to be printed are larger in number and more densely distributed than that in image data 115 of FIG. 5B, so image data 115 of FIG. 5A results in a higher heat weighting W of 6 indicative of more serious heat accumulation during printing for image data 115 of FIG. 5A. Conversely, in image data 115 of FIG. 5B, pixels to be are smaller in number and less densely distributed than that in image data 115 of FIG. 5A, so image data 115 of FIG. 5B results in a higher heat weighting W of −1 indicative of slight heat accumulation during printing for image data 115 of FIG. 5B. Thus, if image data 115 has more successive pixels to be printed, heat weighting for the image data 115 will increase greatly, indicative of the seriousness of heat accumulation during printing for the image. If image data 115 have successive blank pixels among the pixels to be printed, the heat weighting for image data 115 will decrease greatly, indicating that heat accumulation during printing for image data 115 is less serious. Since the heat weighting reflects the degree of heat accumulation, we may calculate the heat weighting when receiving data representing an image and predict the degrees of heat accumulation when printing the image.

Figure 6:
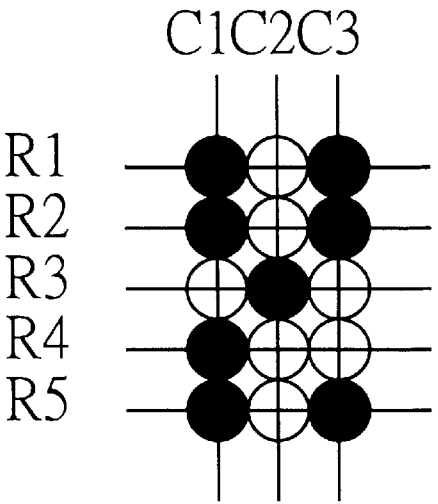
FIG. 6 illustrates the calculation of heat weighting for a two-dimensional image.

Referring to FIG. 6, it illustrates the calculation of heat weighting for two dimensional image data. As shown in FIG. 6, image data 115 contain an array of 5 by 3 pixels, where black dots indicate pixels to be printed. In the calculation of the heat weighting for image data 115 of FIG. 6, the manner that is used in the calculation of the image data of FIGS. 5A and 5B can be used to calculate the heat weighting for each row and each column, and then the summation of the heat weighting for all rows and columns is the heat weighting for the two-dimensional image data 115. The summation of heat accumulation weights and heat release weights for the first column of image data 115 is a+b+A+a+b=2a+2b+A, so the heat weighting for column C1 is equal to 2*1+2*2+=6. The summation of heat accumulation weights and heat release weights for the second column of image data 115 is equal to a, so the heat weighting for column C2 is equal to 1. The summation of heat accumulation weights and heat release weights for the third column of image data 115 is equal to a+b+A+B+a, so the heat weighting for column C3 is equal to 1+2−0−1+1=3. The summation of heat accumulation weights and heat release weights for the first row of image data 115 is equal to a+A+a=2a+A, so the heat weighting for row R1 is equal to 2*1−0=2. The summation of heat accumulation weights and heat release weights for the second row of image data 115 is equal to a+A+a=2a+A, so the heat weighting for row R2 is equal to 2*1−0=2. The summation of heat accumulation weights and heat release weights for the third row of image data 115 is equal to a, so the heat weighting for row R3 is equal to 1. The summation of heat accumulation weights and heat release weights for the fourth row of image data 115 is equal to a, so the heat weighting for row R4 is equal to 1. The summation of heat accumulation weights and heat release weights for the fifth row of image data 115 is equal to a+A+a=2a+A, so the heat weighting for row R5 is equal to 2*1−0=2. The heat weighting W for image data 115 of FIG. 6 is the summation of the heat accumulation weights and heat release weights for all of the rows and columns, i.e. C1+C2+C3+R1+R2+R3+R4+R5=18.

In brief, the heat weighting for image data is calculated according to the locations of the pixels to be printed and blank pixels of the image and the heat weighting look-up table. By the heat weighting for the image data, the degree of heat accumulation during printing according to the image data can be predicted. Data masks can be defined based on the heat weighting for the image data, the locations and densities of the pixels. In this way, the data masks can be better defined for different image data pattern to be printed in order to reduce the heat accumulation. Thus, the heat accumulation is to be more effectively reduced.

For example, if the heat weighting for image data 115 is large, it indicates that the heat accumulation during printing is predicted to be very serious. In order to reduce the heat accumulation, it is required to separate the image into different sub-images and to print the sub-images successively in different time frames. Conversely, if the heat weighting for image data 115 is low, it indicates that the predicted heat accumulation during printing is insignificant. In this case, the printing quality would not be affected by the heat accumulation even if the image separation were not applied to the image data. In addition, the image can be printed with the conventional approach and the good printing quality can be maintained. Therefore, when the heat weighting, the locations and densities of the pixels to be printed are involved, a most suitable manner of image separating can be defined so as to reduce the effect of heat accumulation to a minimum.

Figure 7A:
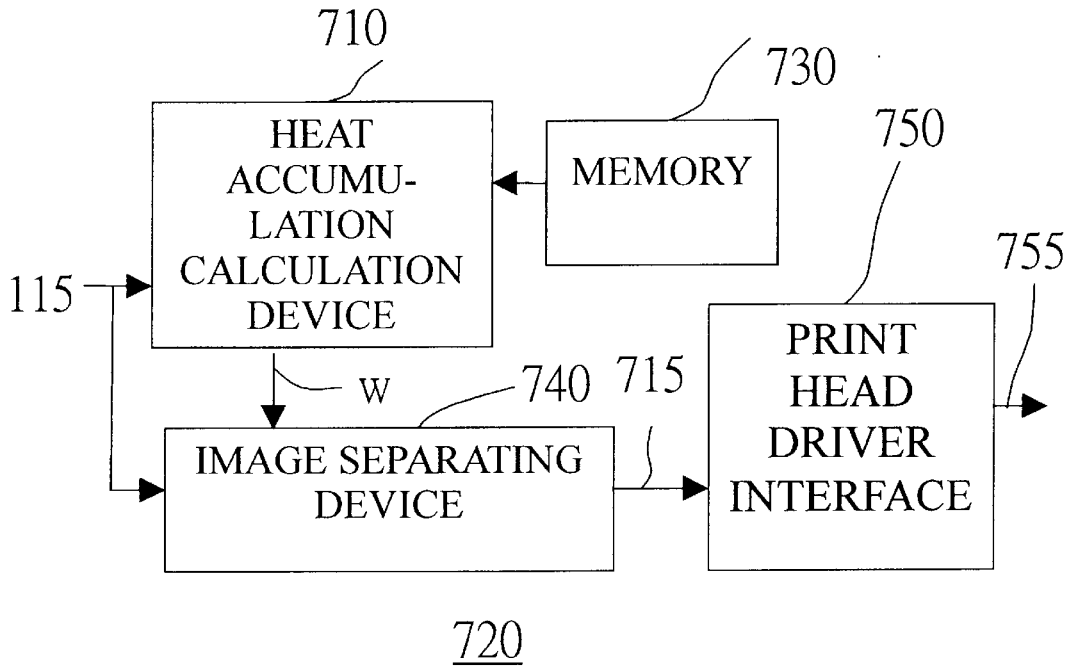
FIG. 7A is a block diagram of a printing controller according to a preferred embodiment of the invention.

As shown in FIG. 7A, a controlling device for inkjet printing is provided according to a preferred embodiment of the invention in block diagram and can be used to implement the image forming method according to the invention. Controlling device 720 for inkjet printing includes a heat accumulation calculation device 710, a memory 730, an image separating device 740, and a print head driver interface 750. The memory 730 is used to store the contents of a heat weighting look-up table including, for example, a heat accumulation table, such as TABLE 1, and a heat release table, such as TABLE 2, and is coupled to the heat accumulation calculation device 710 to provide information for the calculating of heat weighting for an image to be printed. When image data 115 is fed into the heat accumulation calculation device 710, the heat accumulation calculation device 710 calculates the heat weighting W for the image data 115 based on locations of the pixels to be printed and blank pixels of the image data, and feeds the heating weighting W for the image data 115 into the image separating device 740. On receiving the image data 115, the image separating device 740 defines a number of data mask according to, for example, the heat weighting W, the locations of the pixels to be printed and blank pixels, for separating the image represented by the image data 115 into a number of sub-images. The image separating device 740 outputs pieces of image data 715 representative of the sub-images to the print head driver interface 750. On receiving the pieces of image data 715 representative of the sub-images, the print head driver interface 750 outputs a driving signal 755 to drive, e.g., the print head driver 130 so that the print head 140 prints the sub-images successively in different time frames so as to reduce heat accumulation and improve printing quality.

Figure 7B:
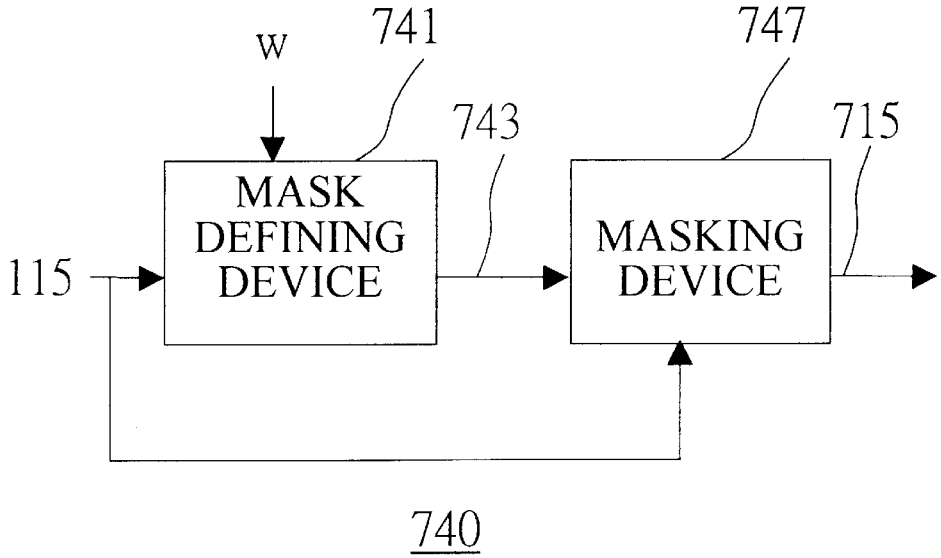
FIG. 7B is a block diagram of an image separating device shown in FIG. 7A.

Referring to FIG. 7B, it illustrates a block diagram of the image separating device 740. The image separating device 740 includes a mask defining device 741 and a masking device 747. The mask defining device 741 is used for defining data masks 743 according to the heat weighting W and information of each of the pixels to be printed, and feeding the data masks 743 into the masking device 747. On receiving the image data 115, the masking device 747, according to the data masks 743, separates the image data 115 into the pieces of image data 715.

In the following description, it is assumed that data masks are defined in accordance with parameters including the locations and densities of the pixels to be printed, and the heat weighting W, and the image data 115 is separated into the pieces of image data representing the sub-images according to the data masks.

As described above, the pieces of image data representing sub-images results from applying data masks to the original image data. For the sake of brevity, this relation between the data masks and the pieces of image data representing sub-images will not be repeated. According to the spirit of the present invention, several examples of generating pieces of image data representing sub-images will be described as follows.

Figure 8:
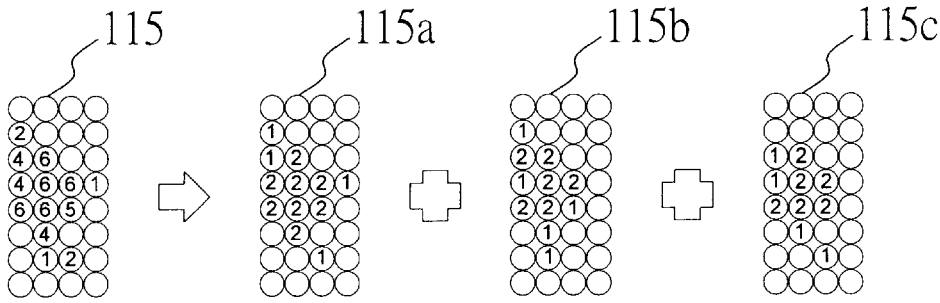
FIG. 8 illustrates the formation of an image by the application of a third method of image forming with inkjet printing techniques according to a preferred embodiment of the invention.

Referring to FIG. 8, it illustrates an image forming method for use in inkjet printing according to the third embodiment of the invention. Image data 115 is an array of 8 by 4 pixels as shown in FIG. 8. For the sake of simplicity, for the image data 115, each of the pixels to be printed is denoted as $P_{ij}$, wherein i is the number of row where the pixel P is located and j is the number of column where the pixel P is located. For instance, the pixel to be printed located at the second row and the first column has a density of two, that is, the density of the pixel $P_{21}$ to be printed is two. The pixel to be printed located at the third row and the first column has a density of four, that is, the density of the pixel $P_{41}$ to be printed is four. This notation for the pixels to be printed will be used in the following. As shown in FIG. 8, the image data 115 has 13 pixels to be printed and the numbers in the circles represent pixels to be printed with specific density levels. The 13 pixels to be printed are of the five density levels, namely, 1, 2, 4, 5, and 6. Most of the pixels located in the middle area of the image are of high density. For example, the densities of both $P_{42}$ and $P_{52}$ are 6 and most of the pixels which are to be printed and are adjacent to $P_{42}$ and $P_{52}$ have the densities over 4. Since these pixels with individual densities are densely distributed, the heat accumulation in the middle area of the nozzles of a print head should be serious. The calculation of heat weighting W for the image data 115 of FIG. 8 may prove such observation. Thus, the image forming method is first to calculate the heat weighting for the image data 115 of FIG. 8 according to the locations of the pixels to be printed and a heat weighting look-up table so as to predict the degree of heat accumulation. Next, data masks defined according to the locations and densities of the pixels to be printed and the heat weighting are applied to the image data 115 of FIG. 8 so as to obtain pieces of image data representing a number of sub-images, each of which has pixels with lower densities and causes reduced heat accumulation during printing. For example, image data 115 is separated into three pieces of image data, namely, sub-image data 115*a*, 115*b*, and 115*c*. Sub-images represented by the three pieces of image data are then printed successively. The three sub-images are to be superimposed on a printing medium so as to form the image represented by the image data 115 of FIG. 8.

Embodiment 4

Figure 9:
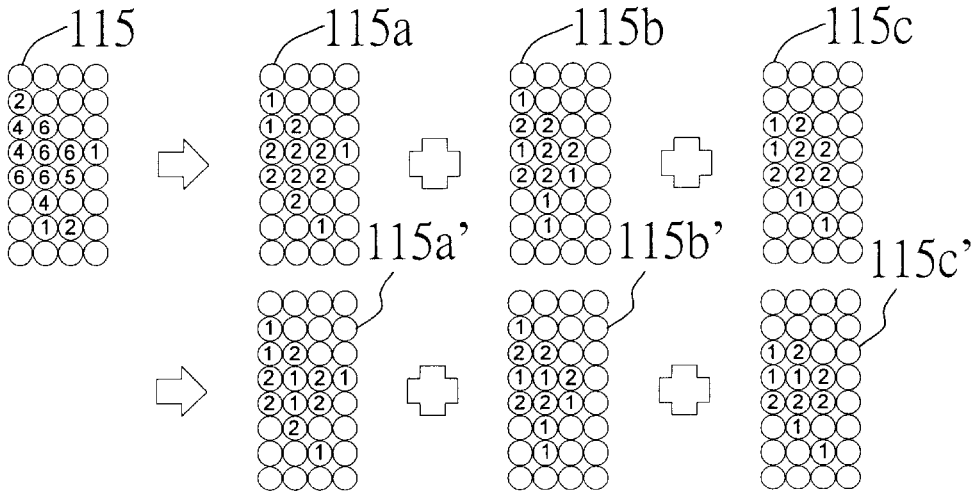
FIG. 9 illustrates the formation of an image by the application of a fourth method of image forming with inkjet printing techniques according to a preferred embodiment of the invention.

FIG. 9 illustrates an image forming method according to the fourth embodiment of the invention. In the fourth embodiment, the way that the image to be printed is separated into a number of sub-images is the same as the way described in the third embodiment. The difference between the third and the fourth embodiments is that in the fourth embodiment, the sub-images are not printed as corresponding pieces of image data, such as sub-image data 115*a*, 115*b*, and 115*c*, are obtained. Additionally, the densities of the pixels to be printed of the pieces of image data are to be deliberately modified before the sub-images are successively printed. In the following, the pixel density adjustment will be described.

The pixel density adjustment is to deliberately reduce the effect of heat accumulation during printing so as to obtain better printing quality. Take sub-image data 115*a* as an example, where $P_{42}$ and $P_{52}$ are surrounded by other pixels to be printed. The nozzles corresponding to $P_{42}$ and $P_{52}$, during printing the associated sub-image, will be affected by the diffusion of heat from the surrounding nozzles, and the heat accumulation in the nozzles corresponding to $P_{42}$ and $P_{52}$ will be more serious than that in other nozzles. The printing pixels with density level one can be regarded as ejecting ink droplets for one time; the printing pixels with density level two can be regarded as ejecting ink droplets for two times; and the printing pixels with density level three can be regarded as ejecting ink droplets for three times. Thus, both $P_{42}$ and $P_{52}$ correspond to two times of ink droplet ejection. The printing pixels with density of one should form the smallest spots on the printing medium while printing pixels with density of three should form the largest spots on the printing medium. Since the nozzles corresponding to $P_{42}$ and $P_{52}$ are affected by the diffusion of heat from the surrounding nozzles, the temperature of the nozzles corresponding to $P_{42}$ and $P_{52}$ becomes higher. The higher the temperature of the nozzles, the bigger the droplets ejected from the nozzles, and the larger the spots formed on the printing medium. Therefore, the ink spots formed on the printing medium corresponding to $P_{42}$ and $P_{52}$ will be undesirably bigger than expected, resulting in poor printing result. For maintaining good printing quality, an adjustment of the image data is required to be made.

According to the present invention, pixel density adjustment is provided to deliberately reduce the effect of heat accumulation due to surrounding pixels with high densities so as to improve the printing quality. Since the nozzles corresponding to $P_{42}$ and $P_{52}$ are affected by the surrounding nozzles and the temperature of the nozzles corresponding to $P_{42}$ and $P_{52}$ rises unavoidably, this heat accumulation effect should be regarded as a variable for printing quality and specific mechanism should be taken to reduce the heat accumulation effect. For example, the densities of $P_{42}$ and $P_{52}$ may be reduced so that they have densities of one; that is, the ink droplets are ejected for one time for the pixels. Theoretically, ejecting ink droplets for one time will form an ink spot about half the size of that formed by ejecting ink droplets for two times. However, with the accumulation effect of heat spread from the surrounding nozzles, the ink spots formed by ejection for one time may be larger than expected and even be close to ejection for two times. Therefore, reducing the pixel densities of the pixels located in high-density pixel clustered regions may further improve the printing quality.

Thus, for reducing the heat accumulation effect on the nozzles corresponding to pixels with high densities, the densities of the pixels of an image which are surrounded by other pixels to be printed with high densities can be reduced. For example, in sub-image data 115*a* of FIG. 9, the densities of pixels to be printed can be modified as sub-image data 115*a*′. As shown in FIG. 9, the densities of $P_{42}$ and $P_{52}$ of sub-image data 115*a*′ are reduced, from density level two to one. Likewise, the densities of pixels to be printed of sub-image data 115*b* of FIG. 9 can be modified as sub-image data 115*b*′. As shown in FIG. 9, the density of $P_{42}$ of sub-image data 115*b*′ is reduced as density of one. The densities of pixels to be printed of sub-image data 115*c* of FIG. 9 are also be modified as sub-image data 115*c*′. As shown in FIG. 9, the density of $P_{42}$ of sub-image data 115*c*′ is reduced as density of one. After the pixel density adjustment, sub-images represented by sub-image data 115*a'*, 115*b'*, 115*c'* are successively printed and the sub-images are superimposed on the printing medium so as to form the image represented by image data 115 of FIG. 9.

Embodiment 5

As noted in the above, before printing, pixel density adjustment can be made on the regions having high density pixels to avoid dots to be printed on the printing medium from being bigger than a normal size due to the effect of heat accumulation occurred in the nozzles corresponding to the regions. In embodiment 4, pixel density adjustment is made on pieces of image data after separation of the original image data. In embodiment 5, pixel density adjustment is made on the image data and then the separation of the modified image data is performed. In this way, the purpose of reducing the heat accumulation effect on the printing quality can also be achieved.

Figure 10:
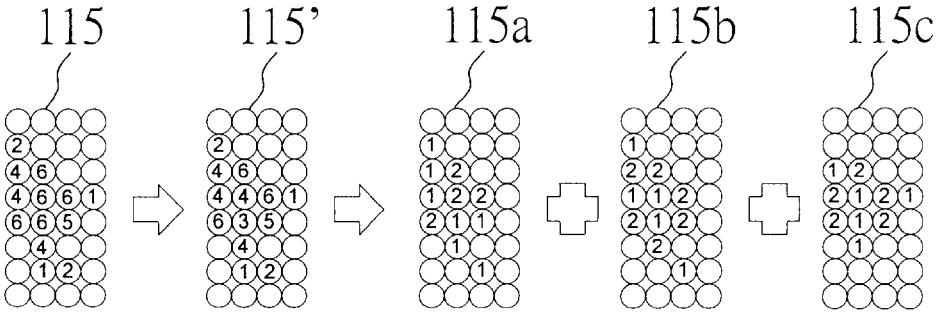
FIG. 10 illustrates the formation of an image by the application of a fifth method of image forming with inkjet printing techniques according to a preferred embodiment of the invention.

Referring to FIG. 10, it illustrates an image forming method according to the fifth embodiment of the invention. As shown in FIG. 10, most of the pixels located in the middle area of the image are of high density. Since these pixels with individual densities are clustered, the heat accumulation in the middle area of the nozzles of a print head is predicted to be serious. If the heat weighting W for image data 115 of FIG. 10 is calculated according to the way described as above, it will correspond to the predicted result. Thus, the image forming method is first to calculate the heat weighting for image data 115 of FIG. 10 according to the locations of the pixels to be printed and a heat weighting look-up table so as to predict the degree of heat i9accumulation during printing. Then, the densities of pixels within areas of the image which may cause serious heat accumulation are modified to avoid the degrading effect of heat accumulation during printing, resulting in, for example, the image data 115'. Next, data masks defined according to the locations and densities of the pixels to be printed and the heat weighting are applied to the modified image data, such as the image data 115', so as to obtain pieces of image data representing m sub-images, each of which has pixels with lower densities and causes reduced heat accumulation during printing. For example, the data image 115' is separated into three pieces of image data representing three sub-images, namely, sub-image data 115*a*, 115*b*, and 115*c* as shown in FIG. 10 respectively. After that, sub-images represented by the pieces of image data are to be printed successively. Finally, the three sub-images are superimposed on a printing medium so as to form the image represented by image data 115 of FIG. 10.

During the image forming method, pixel density adjustment is performed. As shown in FIG. 10, the image data 115 has 13 pixels to be printed that are of the five density levels, namely, 1, 2, 4, 5, and 6. The pixels located in the middle area of the image are of high density and are surrounded by other pixels to be printed. Heat accumulation during printing can be predicted to be seriously occurred in the corresponding nozzles of the print head. For reducing the heat accumulation, the densities of some of the pixels, such as the densities of the pixels that are surrounded by the other pixels with high densities, are reduced. For example, both $P_{42}$ and $P_{52}$ are surrounded by the pixels with density levels not less than four and thus their densities are first modified. The density of $P_{42}$ is reduced from six to four while the density of $P_{52}$ is reduced from six to three. By performing the pixel density adjustment on image data 115 of FIG. 10, the image data 115', which has some pixels with reduced densities, is obtained.

In addition, the image separation is performed on the modified image data after the pixel density adjustment, so that the heat accumulation during printing according to each of the pieces of image data is further reduced. It should also be noted that the pixel density adjustment is performed for reducing the heat accumulation effect due to the areas of the image which have pixels of high densities so that the degraded effect of heat accumulation on the printing quality during printing according each of the pieces of image data can be avoided. Thus, the image formed by the pieces of image data on the printing medium can be substantially regarded as the image represented by image data 115 of FIG. 10.

In the above embodiments of the image forming method, they are applied to inkjet printers for illustrations. In addition, the image forming method according to the invention can be applied to any other image forming apparatuses using inkjet printing technique, such as inkjet facsimile machine, or inkjet copier, to improve the quality of printing. Further, according to the invention, data representative of images that the image forming method can handle, such as image data and sub-image data mentioned in the embodiments above, can be data representative of any kind of images or texts, such as black-and-while images, or color images, or text, or gray-level text and image, or colorful text and image.

According to the invention, an image forming method is provided to form an image on a printing medium by separating data representative of the image into pieces of image data representing sub-images and printing the sub-images represented by the pieces of image data successively on the printing medium. In addition, the image data can be modified deliberately to avoid the serious heat accumulation. The image forming method according to the invention uses image separation and pixel density adjustment to achieve the purpose of avoiding serious heat accumulation, resulting in better printing quality. Further, the invention can also be applied with a thermal resistor on a conventional print head and the determination of data masks can be made according to a measured temperature obtained from the thermal resistor, such a temperature of the print head, or an average temperature of the nozzles.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image forming method for use in an inkjet device for forming an image on a printing medium, the image forming method comprising the steps of:

providing data representative of the image which includes a plurality of pixels to be printed, the pixels having different densities;

determining a heat weighting of the image from locations of the pixels to be printed and a heat weighting look-up table;

providing m data masks for masking the data representative of the image so as to obtain m pieces of image data representing m sub-images, wherein m is an integer greater than one, the m data masks being determined from the heat weighting of the image; and printing the m sub-images successively according to the m pieces of image data representing the m sub-images so that the m sub-images are superimposed on the printing medium, whereby the image is formed on the printing medium.

2. An image forming method according to claim 1, wherein the data representative of the image includes a plurality of pixels to be printed and the pixels to be printed have respective densities, wherein the step of providing the m data masks comprises:

according to locations and the densities of the pixels to be printed, providing the m data masks for masking the data representative of the image so as to obtain the m pieces of image data representing the m sub-images.

3. An image forming method according to claim 1, wherein each of the m pieces of image data representing the m sub-images includes a plurality of pixels to be printed and the pixels to be printed have respective densities, wherein the step of printing the m sub-images comprises:

(a) providing a piece of data, wherein the piece of data is one of the m pieces of image data representing the m sub-images;

(b) according to locations of pixels to be printed from the piece of image data, adjusting densities of the pixels to be printed from the piece of data;

(c) repeating said steps (a) and (b) to perform pixel density adjustment for each of the m pieces of image data representing the m sub-images successively; and (d) successively printing the m sub-images according to the m pieces of image data representing the m sub-images after the pixel density adjustment.

4. An image forming method according to claim 1, wherein the data representative of the image includes a plurality of pixels to be printed and the pixels to be printed have respective densities, wherein the step of providing the m data masks comprises the steps of:

determining a heat weighting for the image, which is based on locations of the pixels to be printed and a heat weighting look-up table;

according to locations of the pixels to be printed, adjusting the densities of the pixels to be printed; and according to the densities of the pixels to be printed after adjusting and the heat weighting for the image, providing the m data masks.

5. An image forming method according to claim 1, wherein the inkjet device is an inkjet printer having a print head comprising a plurality of nozzles to jet ink droplets on the printing medium so as to form the image on the printing medium.

6. An image forming method according to claim 1, wherein the inkjet device is an inkjet facsimile machine having a print head comprising a plurality of nozzles to jet ink droplets on the printing medium so as to form the image on the printing medium.

7. An image forming method according to claim 1, wherein the inkjet device is an inkjet copier having a print head comprising a plurality of nozzles to jet ink droplets on the printing medium so as to form the image on the printing medium.

8. An image forming method according to claim 1, wherein the data representative of the image is gray-scale image data.

9. An image forming method according to claim 1, wherein the data representative of the image is color image data.

10. An image forming method for use in an inkjet device for forming an image on a printing medium, wherein data representative of the image includes a plurality of pixels to be printed and the pixels to be printed have respective densities, the image forming method comprising:

providing the data representative of the image;

generating a heat weighting for the image, which is based on locations of the pixels to be printed and a heat weighting look-up table;

according to the locations of the pixels to be printed, adjusting the densities of the pixels to be printed;

according to the densities of the pixels to be printed after adjusting and the heat weighting value for the image, providing the m data masks; and printing the m sub-images according to the m pieces of image data representing the m sub-images so that the m sub-images are superimposed on the printing medium, whereby the image is formed on the printing medium.

11. An apparatus for controlling inkjet printing, the apparatus comprising:

a memory to store a heat weighting look-up table;

a heat accumulation calculation device, coupled to the memory, for receiving data representative of an image and outputting a heat weighting for the image according to the heat weighting look-up table; and an image separating device, coupled to the heat accumulation calculation device, for receiving the data representative of the image and outputting m pieces of image data representing m sub-images according to the heat weighting for the image;

wherein the image separating device comprises:

a mask defining device, coupled to the heat accumulation calculation device, for receiving the data representative of the image and defining m data masks according to the data representative of the image and the heat weighting for the image; and a masking device, coupled to the mask defining device, for receiving the data representative of the image and generating the m pieces of image data representing the sub-images by successively applying the m data masks to the data representing the image, where m is an integer greater than one.

12. An apparatus according to claim 11, further comprising:

a print head driver interface, coupled to the image separating device, for receiving the m pieces of image data representing the m sub-images and for driving at least a print head so as to print the sub-images successively according to the m pieces of image data representing the sub images.

13. An apparatus for controlling inkjet printing, the apparatus comprising:

a memory to store a heat weighting look-up table;

a heat accumulation calculation device, coupled to the memory, for receiving data representative of an image and outputting a heat weighting for the image according to the heat weighting look-up table;

a mask defining device, coupled to the heat accumulation calculation device, for receiving the data representative of the image and defining m data masks according to the data representative of the image and the heat weighting for the image; and a masking device, coupled to the mask defining device, for receiving the data representative of the image and generating m pieces of image data representing m sub-images by masking the image into the m sub-images according to the m data masks, where m is an integer greater than one.

14. An apparatus according to claim 13, further comprising:

a print head driver interface, coupled to the masking device, for receiving the m pieces of image data representing the m sub-images and for driving at least a print head in order to print the m sub-images successively.

* * * * *